US007384667B2

(12) United States Patent
Blanco

(10) Patent No.: US 7,384,667 B2
(45) Date of Patent: Jun. 10, 2008

(54) SYSTEM AND METHOD FOR PRODUCING SIMULATED OIL PAINTINGS

(76) Inventor: Alberto Blanco, 27 Holmehill La., Roseland, NJ (US) 07068

( * ) Notice: Subject to any disclaimer, the term of this patent is extended or adjusted under 35 U.S.C. 154(b) by 664 days.

(21) Appl. No.: 10/354,655

(22) Filed: Jan. 30, 2003

(65) Prior Publication Data

US 2004/0153204 A1 Aug. 5, 2004

(51) Int. Cl.
*B05D 5/00* (2006.01)

(52) U.S. Cl. ..... 427/208.6; 427/197; 427/208.2; 427/258; 427/260; 427/261; 427/265; 427/288; 427/372.2; 427/398.3; 427/429; 345/419; 345/619; 345/653; 700/118; 700/131; 700/207; 703/6

(58) Field of Classification Search ..... 703/6; 700/207, 118; 345/581; 427/195, 197, 202, 427/261, 262, 265, 208.2, 208.6, 258, 260, 427/288, 372.2, 398.3, 429
See application file for complete search history.

(56) References Cited

U.S. PATENT DOCUMENTS 2,669,797 A * 2/1954 Razzano ..... 427/257
3,975,223 A * 8/1976 Turoff ..... 156/85
5,126,186 A * 6/1992 Cheek ..... 428/195.1
5,239,292 A * 8/1993 Willan ..... 345/441
5,387,380 A * 2/1995 Cima et al. ..... 264/69
5,563,694 A * 10/1996 Katayama ..... 399/2
5,618,338 A * 4/1997 Kurabayashi et al. .... 106/31.37
5,627,578 A * 5/1997 Weintraub ..... 347/101
5,654,036 A * 8/1997 Sugiura ..... 427/264
5,699,743 A * 12/1997 Ganz et al. ..... 101/488
5,844,565 A * 12/1998 Mizutani et al. ..... 345/581
5,939,143 A * 8/1999 Findley et al. ..... 427/256
6,007,318 A * 12/1999 Russell et al. ..... 425/130
6,106,110 A * 8/2000 Gundjian et al. ..... 347/86
6,165,406 A * 12/2000 Jang et al. ..... 264/308
6,193,361 B1 * 2/2001 Wen ..... 347/84
6,322,033 B1 * 11/2001 Lee ..... 248/346.01
6,350,022 B1 * 2/2002 Takemura et al. ..... 347/85
6,375,874 B1 * 4/2002 Russell et al. ..... 264/28
6,428,148 B1 * 8/2002 Gore ..... 347/55
6,486,886 B1 * 11/2002 Silverbrook et al. ..... 345/584
6,569,277 B1 * 5/2003 Gibbs ..... 156/240
6,652,256 B2 * 11/2003 Coe ..... 425/130
6,663,143 B2 * 12/2003 Zirker ..... 283/81
6,718,871 B1 * 4/2004 Fritz ..... 101/3.1
6,804,568 B1 * 10/2004 Miyazaki et al. ..... 700/98
7,048,367 B2 * 5/2006 Roberts ..... 347/101
7,300,146 B2 * 11/2007 Roberts ..... 347/101

(Continued)

*Primary Examiner*—Kamini S Shah
*Assistant Examiner*—Kibrom K Gebresilassie
(74) *Attorney, Agent, or Firm*—Roger M. Rathbun

(57) ABSTRACT

A method and apparatus for producing simulated oil paintings by means of a variety of commercial software programs. A digital color image is created and printed on to a substrate. Also printed on to the same substrate and registered thereto, is a slow drying, clear, embossing liquid in the pattern of brush strokes derived from one or more of the colors printed on to the substrate. A thermographic powder is dusted onto the embossing liquid while still wet and excess powder removed. The substrate is then heated to dry and raise the brush stroke pattern of the embossing ink to create a three dimensional effect on the substrate. The raised brush stroke pattern in combination with printed color image creates a work that has the three dimensional effect simulating an original oil painting.

12 Claims, 5 Drawing Sheets

U.S. PATENT DOCUMENTS

2001/0020964 A1* 9/2001 Irihara et al. ..... 347/43
2003/0020767 A1* 1/2003 Saksa ..... 347/2
2003/0082485 A1* 5/2003 Bulthaup et al. ..... 430/312
2003/0086603 A1* 5/2003 Davidson et al. ..... 382/154
2003/0165655 A1* 9/2003 Coe ..... 428/64.2
2004/0046280 A1* 3/2004 Harrington ..... 264/220
2004/0070106 A1* 4/2004 Harrington ..... 264/227
2004/0094260 A1* 5/2004 Summerfield ..... 156/230
2004/0153204 A1* 8/2004 Blanco ..... 700/207
2004/0183878 A1* 9/2004 Roberts ..... 347/101
2005/0065060 A1* 3/2005 Kin et al. ..... 510/506

* cited by examiner

FIG. 2 Technology of behind textured oil painting produced using inkjet printers FIG. 3 Digital hand stroked oil paintings

SYSTEM AND METHOD FOR PRODUCING SIMULATED OIL PAINTINGS

BACKGROUND

The present invention relates to system and method of producing a simulated oil painting and, more particularly, to a system and method that produces a picture having three dimensional brush strokes on a substrate, such as a canvas, to simulate authentic brush strokes in the particular picture.

Obviously, there is real market for original oil paintings created by an artist, and, depending of course upon the skill and artistry of the creator, such oil paintings can be valuable paintings to the owner. Unfortunately, such original oil paintings, such as portraits, for example, require considerable time to produce and a quality portrait can take time in the order of months to create an original portrait of a person and are therefore considerably costly as well as time consuming to the subject being painted. Certainly, such original works of art are well beyond the means of most persons.

One of the more recognizable features or characteristics of an original oil painting is the three dimensional effect that is created by the artist as the oil paint is applied, that is, the oil paint is actually raised from the flat surface of the canvas in the configuration of the original brush strokes of the artist and those brush strokes are artistically selected and applied by the artist both for color as well as quantity of the paint that is applied to the canvas to bring about a three dimensional effect created by the actual application of the paint to that canvas and which produces the artistic impression desired by the painter.

Accordingly, in order to produce a simulation of an original oil painting, one of the factors is to produce the simulation of the brush stroke effect so that the ultimate product has three dimensional brush strokes that are oriented, to the extent possible, in accordance with actual brush strokes that would be applied by an artist making an original creation.

Currently, there are various techniques that are used in order to produce a simulated oil painting, that is, to create a picture, such as a portrait, landscape or the like, by some mechanical/manual means where the final product has a three dimensional appearance with brush strokes that simulate the real painters brush strokes that would be applied by an artist creating a original oil painting.

One of such current techniques is to produce a portrait or landscape size picture by the use of commercially available painting software packages to produce, from a snapshot or other picture of the desired subject, a picture of the desired size that can be produced by a commercially available printer onto a canvas that has brush strokes that are created by means of the software package. A typical software package that can be used to produce electronically simulated brush strokes in a digitally stored picture is Painter 7™ by the Procreate Division of Corel, Inc.

With such software, the digitized pictures are simply enhanced by adding brush strokes electronically by a palette and an electronic stylus or directly on a computer screen or tablet and the picture so produced can be printed out by means of an ink jet printer to produce a picture that shows brush strokes added by the software program to make the picture look more like an original oil painting. While the brush strokes do enhance the look of the picture, the pictures so created are still two dimensional so that an additional step or steps are required to create a three dimensional effect that is more desirable and more akin to the look of an authentic oil painting.

According, one method of creating the three dimensional effect to the two dimensional computer generated print having brush strokes is to first cover the print with a protective coating. Thereafter, the picture is converted from a two dimensional picture to a three dimensional simulated oil painting by manually applying, by a brush, a gel that dries to a transparent state and which actually stands out from the canvas to give a three dimensional appearance to the picture and which therefore simulates an original oil painting having actual brush strokes. Unfortunately, the aforedescribed step of applying a gel does not necessarily create brush strokes that are aligned with the brush strokes that are simulated by the computer or which would be synchronized or registered with the strokes that would actually be applied by an artist in creating that work. In addition, the aforedescribed technique requires the manual application of the gel to the picture and therefore would be difficult to adapt to automated systems.

As such, therefore, while the aforedescribed technique produces a good simulated oil painting, it would be advantageous to have a system and method of creating a simulated oil painting having three dimensional brush strokes where the actual raised brush strokes more closely are registered or aligned with brush strokes created electronically by the software program so as to better simulate the raised brush strokes that would be created by an artist creating an original work. In other words, it would be advantageous to have a system and method where the actual electronically applied brush strokes themselves could be raised to provide the three dimensional effect rather than relying upon the manual application of a transparent gel that may or may not accurately follow those electronically created brush strokes.

It would be further advantageous to have a system and method of producing simulated oil painting that could be carried out by mechanical and electronic systems and therefore susceptible to a fully automated system approach to the production of the final product by eliminating the need to manually apply the raised portions of the ultimate painting.

SUMMARY OF THE INVENTION

Accordingly, the present invention relates to a method and system for producing a simulated oil painting that can be produced by computer programs and mechanical means, such as commercial printers, so that the overall process of producing the simulated oil painting with a three dimensional effect, can be carried out automatically.

With the present invention, therefore, initially a work, such as a photograph is digitized so as to be available in the form of a digital file and such action may be by a scanner, digital camera or the like. The digital file or work can then be modified with a commercially available software program in a computer to carry out various routines on the work, for example using a commercial program such as PhotoShop® 7 available from Adobe Software, the digital work can be cropped, color corrected and the color generally enhanced in a computer. As a step of the process, the color in the digitized work can be saturated to exaggerate the colors such that the work actually becomes more artistic.

In any event, with the software program, the digitized work can have any glare removed, skin tone enhanced, and the overall work cropped, framed, a border added such that the work is modified to the desire of the user to achieve the particular desired artistic effect of the work. As other possible compositing features, multiple photographs can be combined, the work cut electronically and, in general, modified so that the user can achieve the desired end result of a digital work that is to employ the present invention to produce an enhanced oil painting. The final version is saved and stored in a digital electronic file.

To that enhanced image, the digital electronic file of the enhanced work or painting can then be further processed by the use of another commercially available computer software program known as Painter 7™ by the Procreate Division of Corel, Inc and which adds brush strokes to the digitized work. With the Painter 7™ software program, a set of electronic brushes is used to add brush strokes to the work to produce a color image that has brush strokes added to the image. When the digitized final color image is created and stored in a file, (file X), the software program can also isolate one or more of the brush stroke patterns according to one or more of the colors in file X generated for a printer and isolate the electronic brush strokes for that color in a file (file Y).

Conventionally, a printer such as an ink jet printer receives electronic files from a computer that converts the normal red, blue green colors of the computer to the CMYK color system that is used by the printer to generate the color print. The CMYK represents the colors cyan, magenta, yellow and is the basis of the CMYK color system. With the Painter 7™ software program, the program can isolate one or more of these color files, basically remove the color itself and end up with an electronic file that contains the brush strokes generated for that color. In the preferred embodiment, the yellow file is selected.

Accordingly, the color enhanced and digitized version of the work that has the brush strokes added by the Painter program is printed in the ink jet printer with the four color print of the work with the CMYK color system. After printing, in the preferred embodiment, a sealing coating is applied to the work, now printed on a substrate, such as a canvas and is a full color version of the work.

The file containing only the brush strokes is modified in the Photoshop® to increase the contrast of the brushstrokes. That digital file, identified as file Y, containing the enhanced brushstrokes based on one or more of the colors is then sent to the printer where the printed representation of the file is registered over the original printed work and another printing step is carried out over the first printed work by printing the Y file that has been saved and which is simply the brush strokes of one or more of the colors originally printed, that is, cyan, magenta, yellow or black, preferably yellow, and that brush stroke image is printed over the color printing. The ink jet printer prints the liquid that is configured in the shape of those brush strokes that have been made with respect to one of the colors printed by the ink jet printer. Preferably the liquid is a slow drying, clear varnish.

After printing the clear varnish in the configuration of brush strokes representative of one of the colors, a thermographic powder is dusted on to the canvas such that it adheres to the still wet clear varnish on the substrate and therefore the thermographic powder adheres to the substrate in the pattern of brush strokes on the substrate that are registered with respect to the original work that has also been printed on the same substrate.

The substrate having the color painting overlaid with the clear varnish in the pattern of brush strokes is thereafter heated to dry and raise the thermographic powder, thereby creating a raised pattern of brush strokes in a predetermined pattern configured by the software program and the brush strokes are raised from the surface by the heating step to form three dimensional brush strokes atop of the color image on the substrate, thereby simulating a three dimensional oil painting.

There are alternate embodiments of the aforedescribed preferred embodiment as different steps can be used as variances from that preferred embodiment to achieve and create different looks for the ultimate three dimensional look of an oil painting.

These and other features and advantages of the present invention will become more readily apparent during the following detailed description taken in conjunction with the drawings herein.

DETAILED DESCRIPTION OF THE INVENTION

Figure 1:
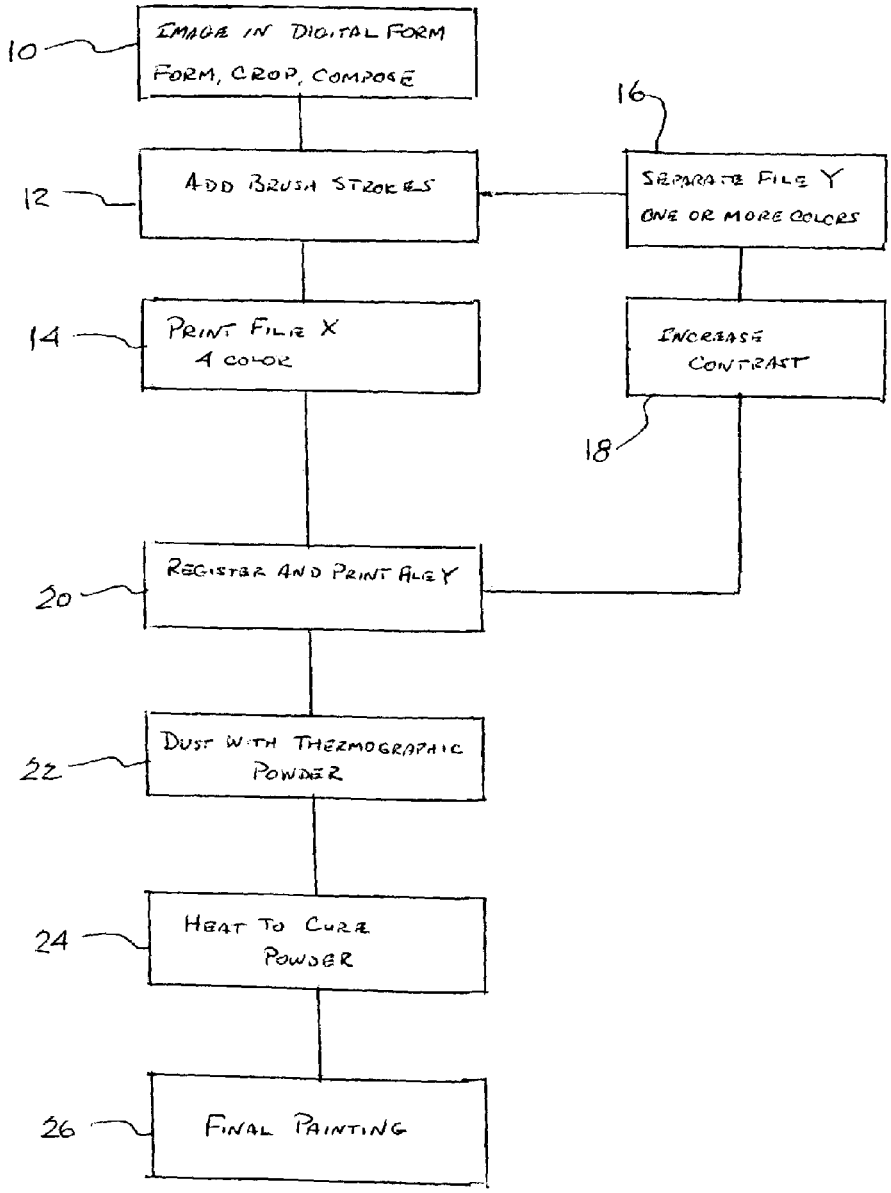
FIG. 1 is flow chart outlining the steps in carrying out the preferred embodiment of the present invention.

Referring now to FIG. 1, there is shown a flow chart illustrating the various steps in carrying out the preferred embodiment of the present invention. As can be seen, the initial step, indicate by the block 10 is to carry out various, somewhat conventional alterations, to a work, such as a photograph, to prepare it for the later steps in creating the desired oil painting look. Thus, the step of block 10 can include the use of commercially available software, such as PhotoShop® 7, marketed by Adobe Software.

Accordingly, as the first steps, the particular work is digitized to enable the software program to make the desire alterations and, of course, to carry out the later steps of the invention. That digitizing can be by means of a scanner, if the work is embodied in a normal color photograph or may be initially digitized, for instance, if the particular work has been memorialized by use of a digital camera or in some other way is available in some electronic medium.

In any event, the digitized form of the work is then processed by the commercial software program to carry out various enhancing and editing steps to process the work into the form desired by the user, for example, the work may be subjected to a color correction to enhance and saturate the colors, particularly skin colors and skin tones, such that the overall work takes on a more artistic form. Additional enhancing features or steps can include cropping of the work, adding borders, composing the work, merging different works into one work or, the opposite, separating out a particular subject from a series of subjects in a work. For example, if the work is a photograph, a particular portion of the photograph may be selected and that portion can be electronically isolated and composed for the processing in accordance with the present invention.

The ultimate product of the processing steps undertaken in block 10 of the flow chart, therefore, is a two dimensional creation of a work that has been processed to select and enhance the particular subject matter that is desired to be subjected to the oil painting simulation process. According, that final product is saved and stored digitally by the computer as a file that is identified for the further processing steps.

Turning now to block 12 of the flow chart of FIG. 1, further processing steps are carried out on the file obtained as a result of the composing and enhancing steps carried out in block 10. In block 12, the digital work from block 10 is processed by means of a further commercial software program that adds brush strokes to the work, and one such program to create the brush stroke effect or pattern is available as Painter 7™ marketed by the Procreate Division of Corel Co.

With such software program that are various ways to add the brush strokes to the digital work, and such means includes the use of a tablet and the brush stroke pattern can be added, for example, by the manipulation of a mouse or a pressure sensitive stylus. Basically the software creates or provides a set of electronic brushes that take the color information from the original digitized work and applies a brush stroke pattern to the work. The brush stroke technique can be in accord with the user's artistry and the strokes can be electronically varied between broad and narrow brush strokes as well as heavy and light strokes; however in any event, the technique via commercial software adds brush strokes to the various colors of the original work.

At this point, taking next the block 14 of FIG. 1, the file, which shall, for convenience, shall be identified as file X is a digital representation of the composed and processed work from block 10 and to which has been added the brush stroke pattern at block 12, is sent to a printer, preferable an ink jet printer, where the file X is printed on to a substrate, such as a canvas, however, other substrates could potentially by employed.

In carrying out the printing process by means of an ink jet printer, the digitized image of the work is converted by the computer system to the four basic colors (CMYK) that are sent separately in files to the ink jet printer in order for the printer to print out those four colors, that is, the printer prints out cyan, magenta, yellow and black dots onto the substrate. The actual blending and resolution of the color image thus printed is therefore a composition of those four colors and the ink jet printer basically prints dots onto the substrate such that the dots are controlled by the software as to their location and size to create an image on the substrate that has multi-colors so that the appearance of the image to the human eye is a color image with a wide variety of blended and patterned colors.

Thus, as can be seen, the electronic version of all four colors is transmitted to the printer such that the printer sees all of the four colors in separate signals or files to cause each particular color to be applied to the substrate in a series of dots that project that particular color of ink onto the substrate. As a further step in block 12 a sealer is applied to the finished printed work to protect the work during the subsequent steps in the present invention. That sealer may be a lacquer based varnish or water based depending upon the type of ink.

Accordingly, returning now to Block 12, a separate file is isolated from the file X and is stored and saved as a separate file, labeled file Y for convenience, and which contains the brush stroke pattern representative of one or more of the color files available for the printer. The step is shown in block 16. In the preferred embodiment, the yellow color pattern is utilized, however, other colors could be used with the black color file being the least desirable in carrying out the present invention. As a further embodiment, more than one of the color files can also be used in accordance with the further steps of the invention.

Thus, file Y is separated from the multi-color file X and the file Y is, therefore, a digital represent of a brush stroke pattern of the selected color within the composite work for block 12. The Painter™ software program can continue to be used such that the actual color, for instance, the yellow color, is electronically removed from the brush stroke pattern of that color such the digital file Y thereafter only contains an electronic representation of the brush stroke pattern for that color, but the electronic representation is otherwise colorless.

As indicated in block 18, that digital representation of the brush strokes in file Y can then be enhanced by resort to the PhotoShop® software program to increase the contrast of the brush stroke pattern electronically.

Accordingly, the enhanced contrast representive of brush strokes developed at block 18 is sent to an ink jet printer in block 20. At this step, the color print that has been sealed at block 12 having the full color work printed on the substrate, is introduced into a printer at block 20 and the brush strokes stored in file Y are printed atop of the color print.

In carrying out this step, the printer is basically printing the brush strokes representing one, or more, of the colors held in file Y and the printing of that brush stroke pattern is registered onto the substrate such that the printed liquid registers with the particular color, for example, yellow, for that brush stroke pattern and the printer now prints a liquid in the brush stroke pattern of the yellow color onto the color print such that the brush stroke registers with the yellow ink dots that were printed onto the substrate in block 12. Accordingly, the brush stroke pattern is printed in a predetermined pattern that is consistent with the actual work itself and not in a random fashion as was carried out in the prior art.

The liquid, also called an embossing ink, that is printed onto the substrate in the block 20 may be a variety of liquids, even a color ink, however it is preferred that the liquid be a colorless liquid such that the registration process need not be as precise as when an actual color is applied to the substrate. Instead, the preferred liquid is a clear varnish, and can be comprised of glycerin, water and a retarder to prolong the drying process of the liquid. With the preferred liquid, the drying process can take up to about twenty minutes to completely dry that liquid printed onto the substrate. As will be seen, it is important that the drying of the liquid be retarded in order to effectively carry out the next step in the inventive process.

Taking, therefore, the next step, as depicted by the block 22, a thermographic powder is dusted on to the substrate and that thermographic powder adheres to the still wet liquid that has been printed onto the substrate in block 20. The thermographic powder is a commercially available product and is commonly used in the printing trade to raise the printing on calling cards, letterhead and the like. The thermographic or embossing powder can be obtained in a variety of consistencies and the user can, therefore, select from a fine powder to a course powder with a wide variety of intermediate consistencies. The excess powder can be blown off from the substrate such that what is left is the liquid or embossing ink having the thermographic powder adhered thereto in the pattern of brush strokes representative of a particular color or colors originally printed on the substrate in the steps carried out in block 12.

In block 24, therefore, the substrate itself is heated to about at least a predetermined temperature, generally about 250 degrees Fahrenheit, sufficient to cause the liquid to fully dry and for the thermographic powder to raise off of the substrate to form a three dimensional appearance in a brush stroke pattern on the substrate.

Lastly, in block 26 the final product simulated oil painting is produced that has a three dimensional effect since the brush stroke pattern laid down by the liquid in the steps of block 20 has been raised and that brush stroke pattern fits in with the actual content of the work itself since it is based on one, or more, of the actual colors that were printed onto the originally printed work in the steps of block 14.

Figure 2:
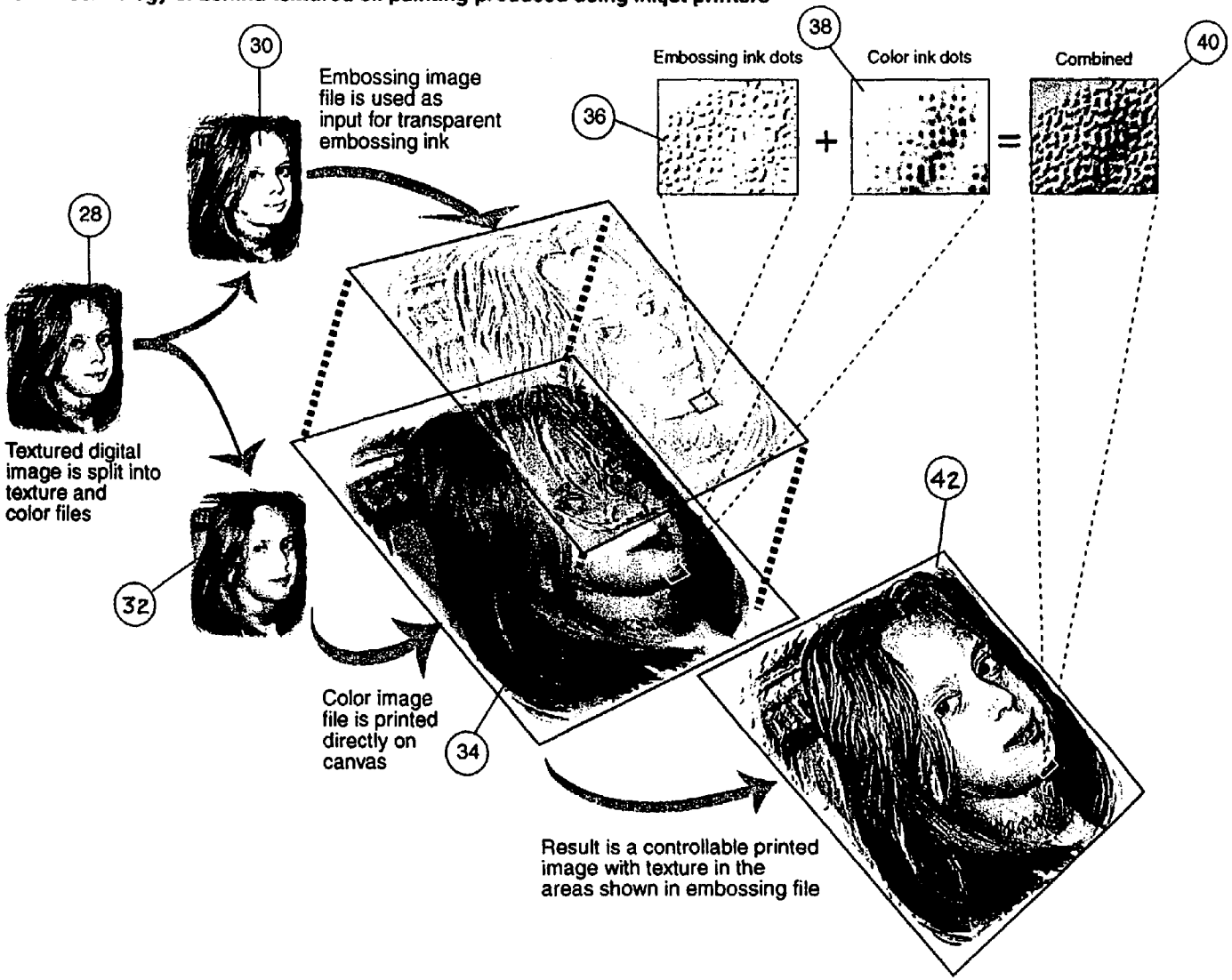
FIG. 2 is a schematic view showing the actual steps carried out in the preferred embodiment.

Turning now to FIG. 2, taken along with FIG. 1, there is shown a schematic view of the method of the present invention. In FIG. 2, the image 28 is representative of the textured digital image that is produced as a result of the steps in block 12, that is, the image 28 is a color image with a brush stroke pattern in the image. As can be seen, the image 28 is broken into two files, an embossing image 30 that contains a digital pattern of brush strokes based upon one or more of the colors in the image 28 and a full color image 32 that simply is the full color image, including the brush stroke pattern, of the image 28.

The full color image 32 (file X) is printed onto a substrate 34, such as a canvas, to produce a printed, full color version of the particular work shown in the initial image 28. After a sealing step, the embossing image 30 (file Y) is registered with the color image on the substrate 34 and that embossing image 30 is basically an electronic version of brush strokes based upon one or more of the colors of the full color image 32. As such, the embossing image 30 is printed atop of the full color image 32 that has been printed onto the substrate 34.

FIG. 2 also illustrates the actual ink dots and, as can be seen, there are embossing ink dots 36 that are printed onto the substrate 34 in the pattern of brush strokes with the embossing liquid or ink and there are full color dots 38 that are color dots that are printed onto the substrate 34 to produce the full color image.

Thus, the combined dots 40 that are printed on to the substrate 34 result, after the heating step, in a final simulated oil painting 42 that has both a full color image as well as a texture or three dimensional brush strokes pattern on the substrate 34.

Figure 3:
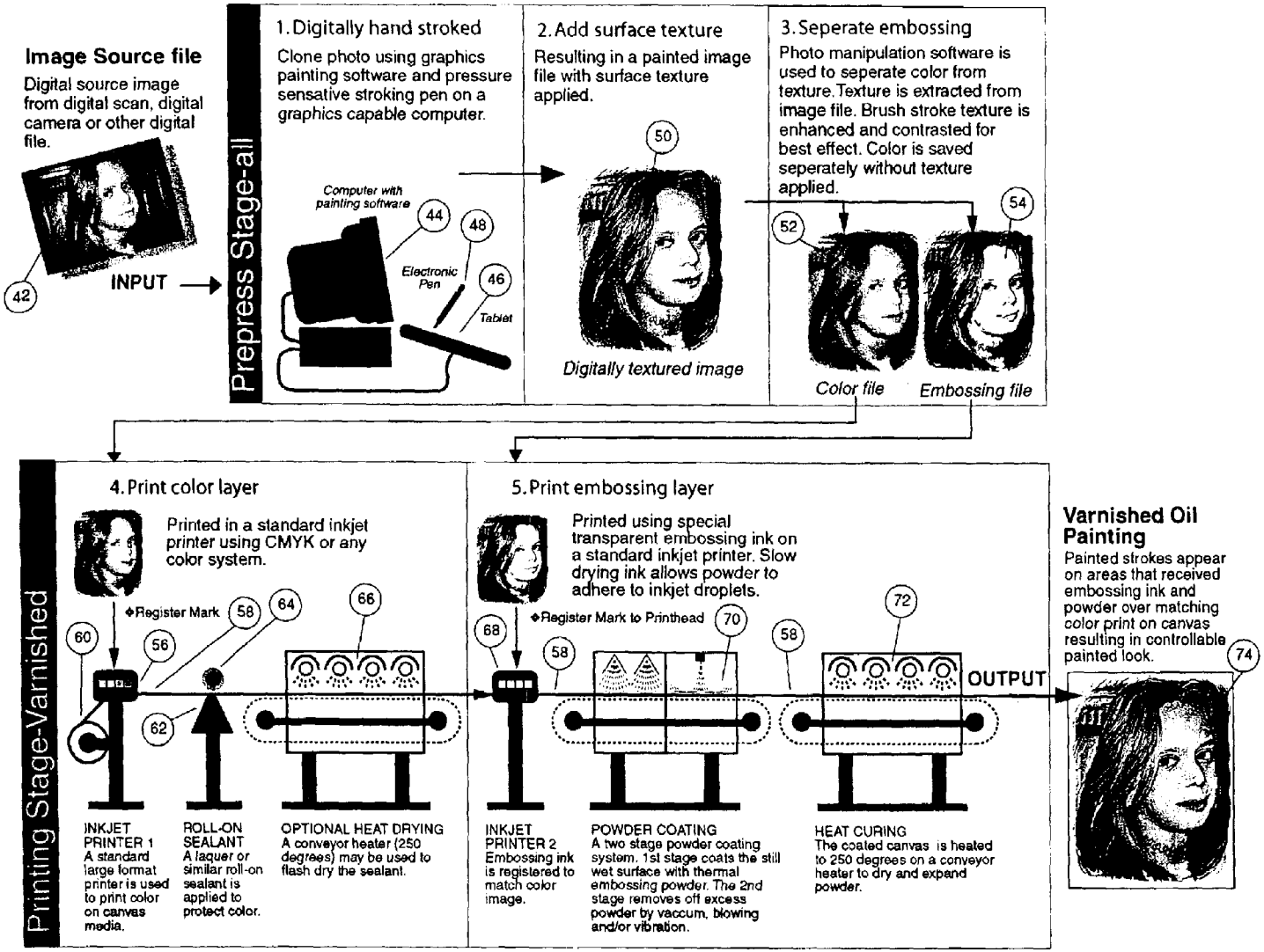
FIG. 3 is a schematic view illustrating the system used to carry out the present invention.

Turning now to FIG. 3, there is a schematic view illustrating the steps of one of the embodiments of the present invention and showing apparatus that can be used to carry out that embodiment. Accordingly in FIG. 3, there is a input work 42 that, as explained, can be the result of a digital photograph, a picture that has been digitized by means of a scanner or some other work that is embodied in a digital form.

That digital image is the inputted to a graphics capable computer 44 where the digital image is cloned by the use of graphics painting software, such as Painter 7, where a tablet 46 is used in conjunction with an electronic pen 48. Basically the digital image is projected upon the tablet 46 and the electronic pen 48 used to add the brush stroke pattern electronically on to the digital image. The electronic pen 48 can be adjusted in accordance with the commercially available software to change the width of the brush strokes and the electronic pen 48 can lay heavy or light stokes in accordance with the touch of the user.

Thus, the textured digital image 50 is created and stored in a file of the computer. That file, file X, is stored as the color image 52 and includes the four colors, cyan, magenta, yellow and black, although other colors and printers can be utilized. A separate file is extracted from the full color file, file X, and is separated out and stored as a file Y. The file Y is an embossing image 54 and is based upon one or more of the individual color files from the color image 52, preferably the yellow color file. The Y file is basically the brush stroke pattern for that selected color and the color is electronically removed and the brush strokes are electronically enhanced, thereby ending up with the embossing image 54 that is essentially enhanced brush strokes based upon one or more of the color images of the textured digital image 50.

The stored, full color image 52 is then printed by means of a first ink jet printer 56 into which is fed a substrate such as a canvas 58 from a roll 60 of the canvas 58 in order to fully automate the system. During this printing process a register mark is also applied to the canvas 58 in order to provide a point of reference for a later printing step. The first ink jet printer 56 is preferably the ink jet type utilizing a CMYK color system but may be other types of printer and may utilize other color systems. After the canvas 58 has the color image printed on it by the first ink jet printer 56, the canvas 58 continues on to a sealing apparatus 62 where a roller 64 applies a sealant, such as a lacquer based varnish, so that the color image that has been printed onto the canvas 58 is protected.

A dryer 66 then receives the canvas 58 and is an optional step where a drying function flash dries the sealant material that has been applied to cover and protect the color work that has been printed onto that canvas 58. When used, the dryer 66 can provide a temperature of about 250 degrees F.

Continuing, the embossing image 54 is the printed onto the canvas 58 by means of the second ink jet printer 68. Obviously, while the embodiment described in FIG. 3 is intended to be a fully automated process, it is understood that in a non-fully automated system the second ink jet printer 68 and the first ink jet printer 56 can be the same printer.

In any event, the second ink jet printer 68 prints the embossing image 54 on to the canvas over the top of the work that has been color printed by the first ink jet printer 56. The two images, that is, the full color image 52 and the embossing image 54 are registered by the register mark so that the images are aligned with respect to each other. The liquid used by the second ink jet printer 68, that is, the embossing ink, can be a transparent embossing ink that is a varnish having a retarding agent added to slow the drying of that liquid, and preferably is a solution of glycerin, water and the retarder to achieve a drying time in the order of about twenty minutes of longer.

After printing the embossing image 54, which is basically printing a clear, slow drying liquid onto the canvas in the pattern of brush strokes, the canvas 58 enters a powder coater 70 where a thermographic powder is coated on to the printed work such that the thermographic powder adheres to the embossing image 54 that is still wet on the canvas 58. As a second function in the powder coater 70, the excess powder is removed by a vacuum system, by blowing the powder off of the canvas 58, or by means of a vibration.

Next, the canvas 58, now having the embossing image 54 coated with the thermographic powder, enters a curing heater 72 where the coated canvas is heated to a predetermined temperature, generally about 250 degrees F., to dry and expand the thermographic powder.

Finally, the completed simulated oil painting 74 is formed wherein the painted brush stroke pattern that appears on areas that received the embossing ink and powder over the matching color image 52 is raised to a three dimensional effect to result in a controllable oil painted appearance to the final painting work.

Figure 4:
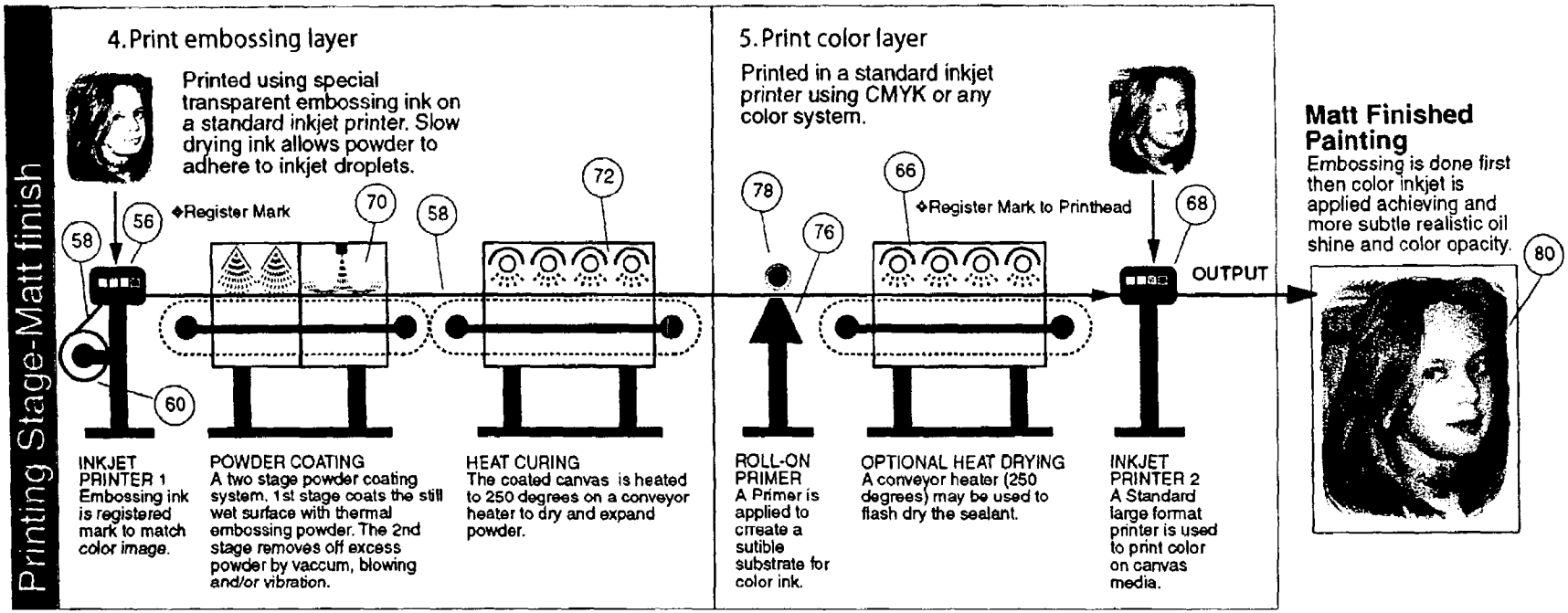
FIG. 4 is a schematic view of an alternate embodiment of the invention.

Turning next to FIG. 4, there is shown an alternate embodiment of the present invention where the initial steps, that is, up to the point the separate file X and file Y are formed to provide the stored color image 52 and the embossing image 54 are the same. However, in this embodiment, the embossing image 54 is first printed onto the canvas 58 by means of the first ink jet printer 56 that prints the embossing liquid in the pattern of brush strokes while applying a register mark.

Again, as before, the embossing liquid or ink is a clear, slow drying liquid and the powder coater 70 applies the thermographic powder to the embossing ink while still wet and again removes the excess powder that does not adhere to the embossing ink. The thermographic powder in the brush stroke pattern is then passed through the curing heater 72 to dry and expand the powder to form the three dimensional pattern of brush strokes on the canvas 58.

The canvas thereafter passes through a primer apparatus 76 where a primer roller 78 coats the canvas over the image printed by the first ink jet printer 56 to create a suitable substrate for the color ink to be applied. Optionally the canvas having the primer coat is passed through dryer 66 where the canvas is heated to dry the primer coat.

Finally, in this embodiment, the canvas passes through the second ink jet printer 68 where the full color image 52 is printed onto the canvas over and registered to the already raised pattern of brush strokes to achieve the three dimensional effect but in a matte finish that provides a more realistic oil shine and color opacity than the simulated oil painting 80 that is produced by the embodiment illustrated in FIG. 3.

Figure 5:
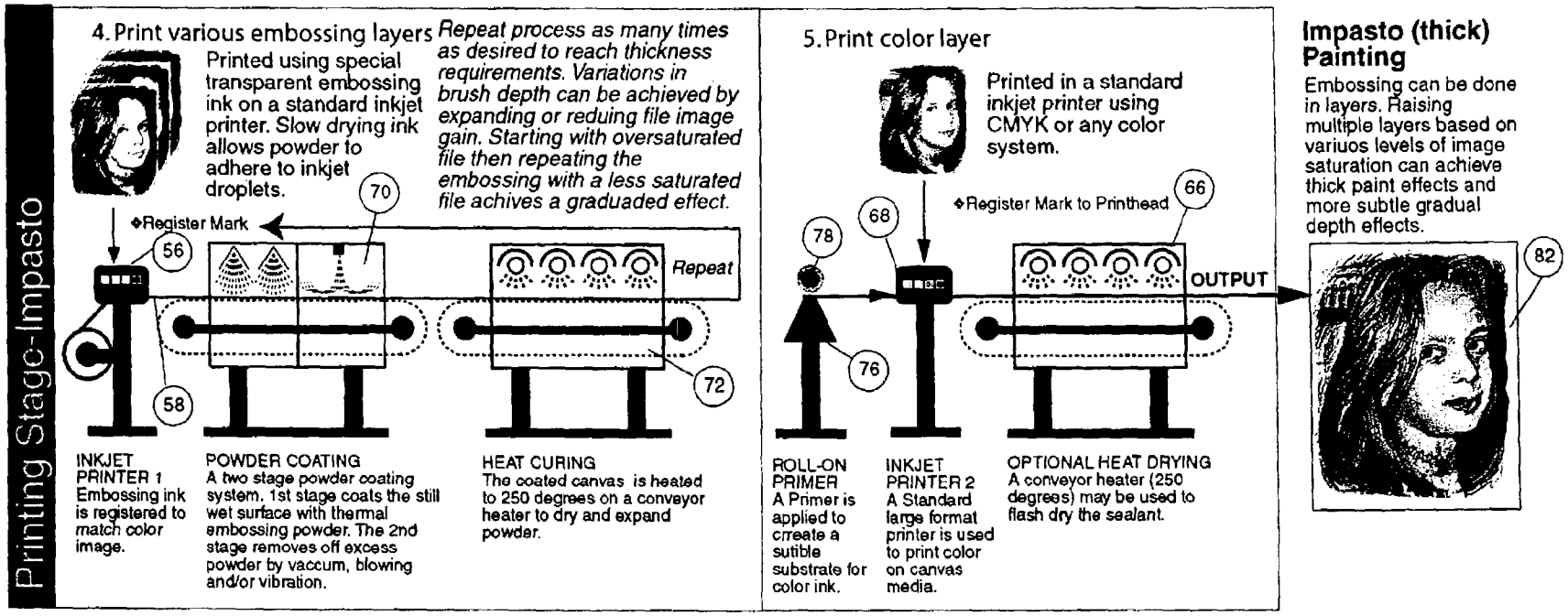
FIG. 5 is a schematic view of a still further alternate embodiment of the invention.

Turning finally to FIG. 5, there is shown a schematic view of a still further embodiment of the present invention. Again in the FIG. 5 embodiment, the initial steps that create and store the color image 52 and the embossing image 54 are the same as described with respect to the FIGS. 3 and 4 embodiments.

In this embodiment, the embossing image 54 is first printed by means of the first ink jet printer 56 to print the brush stroke pattern onto the canvas 58. As in the FIG. 4 embodiment, the printed canvas 58 enters the powder coater 70 where the thermographic powder is coated onto the wet embossing ink and the excess thermographic powder removed from the canvas 58. The canvas 58 continues on to the curing heater 72 that heats the canvas 58 to dry and expand the thermographic powder to achieve the three dimensional effect on the canvas 58 in the pattern of brush strokes.

In this embodiment, however, the canvas 58 passes through the curing heater 72 and then is reprinted with an additional coating or coatings of the embossing ink to reach a desired thickness, that is, the embossing ink can be continued to be applied to the canvas 58 in successive layers and, each time, the canvas passes through the powder coater 70 and the curing heater 72 to build up the three dimensional effect to a greater degree than with the embodiments of FIGS. 3 and 4. Too, with this embodiment, the embossing image can be altered and changed to apply different depths of brush strokes or altering the gain of the embossing image file. The degree of saturation can also be changed from an oversaturated file to a less saturated file to achieve a graduated three dimensional effect.

After the desired number of repetitions of the printing of the embossing image 54 have been completed, the canvas 58 can continue on to the primer apparatus 76 where the primer roller 78 adds the primer to coat the images printed by the first ink jet printer 56. Thereafter, the second ink jet printer 68 is used to apply the stored color image 52 onto the multiple layers of brush stroke patterns and, optionally, the dryer 66 is used to dry the color image onto the canvas 58 to finally produce the thick simulated oil painting 82 that achieves thick paint effects and more subtle gradual depth effects.

Those skilled in the art will readily recognize numerous adaptations and modifications which can be made to the simulated oil painting process and apparatus of the present invention which will result in an improved simulated oil painting, yet all of which will fall within the scope and spirit of the present invention as defined in the following claims. Accordingly, the invention is to be limited only by the following claims and their equivalents.

I claim:

1. A method for producing a simulated oil painting having brush strokes on a substrate, said method comprising the steps of:

(a) providing a substrate, (b) applying ink to the substrate in a plurality of colors, each of the plurality of colors being applied to the substrate having a brush stroke pattern, (c) subsequent to the completion of step (b), separately applying a liquid to the substrate overlying the ink in the same brush stroke pattern as at least one of the plurality of colors applied in step (b) including registering the pattern of the liquid to be in alignment with one of the predetermined brush stroke patterns of a color applied in step (b), (d) dusting a thermographic powder onto the liquid applied in step (c) prior to the liquid becoming dry, (e) heating the liquid containing the thermographic powder to cause the liquid to dry and physically raise from the substrate to produce a raised, three dimensional effect in the configuration of the brush stroke pattern applied in step (c).

2. The method for producing a simulated oil painting as defined in claim 1 wherein said step of providing a substrate comprises providing a canvas.

3. The method for producing a simulated oil painting as defined in claim 1 wherein the step of applying a liquid in step (c) comprises applying a slow drying clear varnish.

4. The method for producing a simulated oil painting as defined in claim 3 wherein the step of applying a liquid in step (c) comprises applying a slow drying varnish having a retarding agent to delay the drying of the varnish.

5. The method for producing a simulated oil painting as defined in claim 1 wherein the method includes the step of providing an ink jet printer and the step of applying ink to the substrate in step (b) comprises applying the ink by means of the ink jet printer.

6. The method for producing a simulated oil painting as defined in claim 5 wherein the step of applying the liquid in step (c) comprises applying the liquid by means of the ink jet printer.

7. The method for producing a simulated oil painting as defined in claim 1 wherein the step of applying ink to the substrate in a plurality of colors comprises applying cyan, magenta, yellow and black inks.

8. The method for producing a simulated oil painting as defined in claim 7 wherein the step of apply a liquid in step (c) of claim 1 comprises applying the liquid in the predetermined pattern of the yellow ink applied in step (b) of claim 1.

9. A method of creating a raised paint brush stroke pattern on a substrate, said method comprising the steps of:

(a) providing a substrate, (b) providing a digital file containing electronic data adapted to form a plurality of printed paint brush stroke patterns, (c) separating the digital file into a first digital file containing a plurality of brush stroke patterns and a second, embossing, digital file containing a brush stroke pattern of one of the plurality of brush stroke patterns, (d) providing a printer, (e) inputting the first and second digital files to the printer (f) printing the first digital file onto the substrate to print the liquids onto the substrate in the form of a plurality of brush stroke patterns, (g) after the completion of the printing step (f), separately and independently printing the second digital file onto the substrate to print an embossing liquid onto the substrate, (h) dusting the liquid applied to the canvas in step (g) with a thermographic powder while the liquid is still wet to cause the thermographic powder to adhere to the liquid in the brush stroke pattern, and (i) heating the substrate to cause the thermographic powder to dry and raise from the surface of the substrate to physically form a raised brush stroke pattern on the substrate.

10. The method of creating a raised paint brush stroke pattern as defined in claim 9 wherein said step of printing a liquid onto the substrate set forth in step (g) comprises printing a slow drying varnish onto the substrate.

11. The method of creating a raised paint brush stroke pattern as defined in claim 10 where the step of printing a liquid comprises printing a liquid comprised of glycerin, water and a drying retarder.

12. The method of creating a raised paint brush stroke pattern as defined in claim 9 wherein the step of providing a substrate comprises providing a canvas.

* * * * *